US005350046A

United States Patent [19]

Falloon et al.

[11] Patent Number: 5,350,046

[45] **Date of Patent: * Sep. 27, 1994**

[54] LUGGAGE CASE WITH PULL HANDLE

[75] Inventors: Thomas Falloon, Pittsburgh; Hyun S. Kim, New Castle, both of Pa.

[73] Assignee: Airway Industries, Inc., Ellwood City, Pa.

[ * ] Notice: The portion of the term of this patent subsequent to Nov. 24, 2009 has been disclaimed.

[21] Appl. No.: 979,149

[22] Filed: Nov. 23, 1992

Related U.S. Application Data

[63] Continuation-in-part of Ser. No. 812,724, Dec. 23, 1991, Pat. No. 5,165,508.

[51] Int. Cl.[5] ..... A45C 13/26

[52] U.S. Cl. ..... 190/115; 190/127

[58] Field of Search ..... 190/18 A, 18 R, 115, 190/127

[56] References Cited

U.S. PATENT DOCUMENTS

| | | | |
|---|---|---|---|
| 2,042,387 | 5/1936 | Cobb . | |
| 2,392,926 | 7/1943 | Kelly . | |
| 2,581,417 | 1/1952 | Jones . | |
| 2,585,209 | 2/1952 | Abbott . | |
| 2,765,106 | 10/1956 | Platt et al. | 190/115 X |
| 2,804,900 | 9/1957 | Lifton . | |
| 3,297,120 | 1/1967 | Bush | 190/115 |
| 3,592,314 | 7/1971 | Jacobson . | |
| 3,805,929 | 4/1974 | Kuwayama . | |
| 4,087,102 | 5/1978 | Sprague | 190/18 A X |
| 4,299,313 | 11/1981 | Null . | |
| 4,418,804 | 12/1983 | Bradley et al. . | |
| 4,738,340 | 4/1988 | Crespi | 190/115 X |
| 4,813,520 | 5/1989 | Lin . | |
| 4,838,396 | 6/1989 | Krenzel . | |
| 4,873,841 | 10/1989 | Bradshaw et al. . | |
| 4,890,705 | 1/1990 | Pineda . | |
| 4,966,259 | 10/1990 | Bergman . | |
| 4,995,487 | 2/1991 | Plath . | |
| 5,048,649 | 9/1991 | Carpenter et al. . | |
| 5,054,589 | 10/1991 | Bomes et al. | 190/18 A |
| 5,165,508 | 11/1992 | Kim | 190/115 |

*Primary Examiner*—Allan N. Shoap
*Assistant Examiner*—Christopher McDonald
*Attorney, Agent, or Firm*—Walter J. Blenko, Jr.; George K. Stacey

[57] ABSTRACT

A suitcase having a pull handle. The pull handle is rotatably affixed to the suitcase with a bracket means to assist the user of the suitcase in pulling same across a flat surface in upright position.

11 Claims, 4 Drawing Sheets

LUGGAGE CASE WITH PULL HANDLE

This is a Continuation-in-Part of U.S. Pat. application Ser. No. 812,724, filed Dec. 23, 1991, now U.S. Pat. No. 5,165,508.

FIELD OF THE INVENTION

The present invention relates to luggage, and particularly to luggage having a pull handle to enable the user to pull the luggage across smooth surfaces, such as airport walkways and the like.

DESCRIPTION OF THE PRIOR ART

Conventional suitcases, luggage, baggage, and the like available on the market may generally be grouped into three types: rigid, semi-rigid, and collapsible.

Rigid luggage is generally nondeformable on every surface thereof, offering the advantage of durability and maximum protection for the contents contained therein. Semi-rigid luggage generally is fashioned from a series of pliable sides supported by inner rib members which provide shape and strength to the luggage. Collapsible baggage may include duffle-bag-type luggage having no internal supports or luggage of the type discussed in U.S. Pat. No. 4,813,520 having removable external supports, which may be folded for minimizing storage space when the collapsible baggage is not in use.

A common problem, typical of large sizes of luggage, is the tendency of the luggage to hold more weight than can be effectively or ccmfortably carried by hand over long distances. Several means of alleviating this problem have been developed, including folding luggage carts, and the use of rollers or casters on the bottom surface of the luggage coupled with a leash or strap or other means for pulling the luggage across a surface.

Such devices typically result in a piece of luggage that is difficult to control, however, especially in the frenetic environment in which such devices typically are used, such as airports, taxi stands, crowded sidewalks and the like. One frequent problem is the tendency of wheeled luggage to deviate from a straight path and sway back and forth, and in the extreme case to wobble and fall over on its side.

SUMMARY OF THE INVENTION

The present invention solves the above problems of the prior art by providing a suitcase having spaced, generally parallel front and back sides connected about their periphery to a peripheral wall member extending between the front and back sides thereby defining a volume. A stiff spine may be affixed to the wall member around the periphery thereof, this spine providing support to the wall member. Optionally, the wall member may itself act as a stiff spine for purposes of the invention. The invention further includes a rigid pull handle connected to the spine at separated points positioned transversely of the spine, the pull handle being pivotally mounted on an axis transverse to the spine and rotatable about that axis between a pulling position in which the handle extends outwardly from the suitcase and a storage position in which the handle is in juxtaposition to the peripheral wall member. The handle permits the suitcase to be pulled across a surface substantially without fishtailing when the handle is in the pulling position.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

Figure 1:
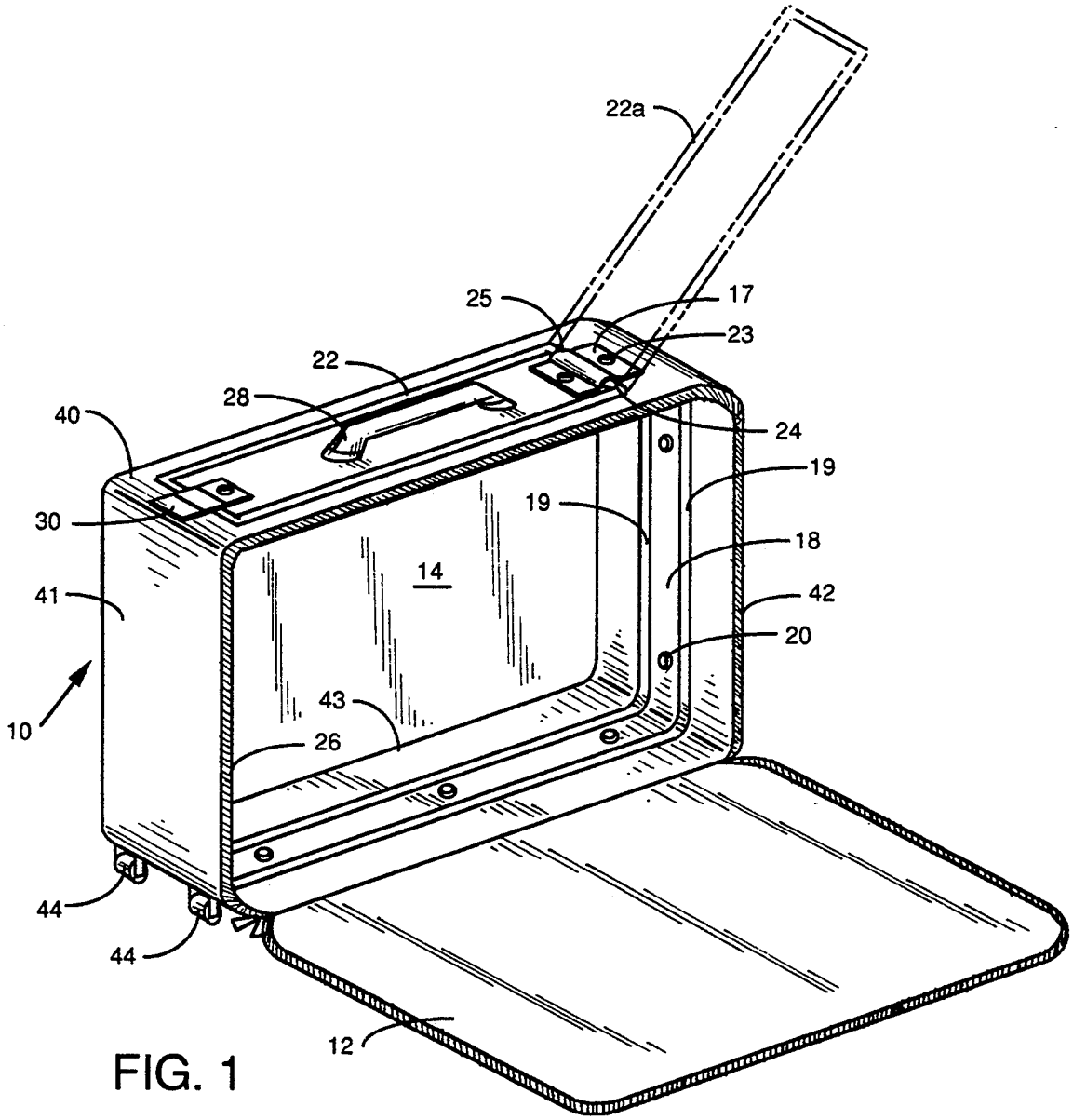
FIG. 1 is an isometric perspective view of a preferred embodiment of the invention.

Referring to FIG. 1 there is illustrated an opened suitcase generally 10 comprising a front side 12 and a back side 14 having a peripheral wall member 16 connected about the periphery of the front and back sides and extending between the front and back sides thereby defining volume in the suitcase, the volume being contained when the front side 12 is closed.

The suitcase 10 illustrated in FIG. 1 comprises a semi-rigid suitcase, fabricated of, for example, a polymeric material and/or fabric, such as reinforced nylon. The embodiment of FIG. 1 includes a spine 18 which is affixed to the peripheral wall member 16 and extends around the periphery thereof. The spine 18 is a generally rigid material, such as PVC, aluminum, and the like, and may include a pair of stiffening ribs 19 to add further support to the spine 18. The spine is affixed to the wall member 16 by a plurality of fasteners 20, which may comprise rivets or any other fastening means known to those skilled in the art.

Alternatively, the spine 18 may comprise the entire peripheral wall member 16, as would generally be the case when a rigid suitcase 10 is provided. In such case, the front and back sides and peripheral Wall member therebetween comprise a rigid material, such as metal sheet, the wall section of a molded shell, reinforced fabric, heavy-duty plastic, and any other rigid material well known to those skilled in the art.

Consequently, as used herein, the term "spine" refers to and includes both a separate spine member 18 fastened to a semi-rigid or flaccid peripheral wall member 16, as well as a rigid wall member 16 which extends between the front and back sides 12 and 14.

As also seen in FIG. 1, the preferred embodiment of the invention includes a pull handle 22 which is connected to the spine 18 at separated points 24 and 25. The pull handle 22 preferably comprises a rigid material, such as steel or aluminum rod and may be covered in a soft fabric or other aesthetic material.

The separated points 24 and 25 allow the handle 22 to be rotated about an axis transverse to the spine as illustrated by the phantom lines representing the handle in a pull position 22*a*, in which the handle extends outwardly from the suitcase to allow the suitcase 10 to be pulled across a surface. The rotatable handle may likewise be rotated into a storage position 22 in which the handle is in juxtaposition to the peripheral wall member 16 as illustrated. Optionally, the suitcase 10 may be provided with a retaining means 30 for retaining the handle 22 in the storage position.

Figure 2:
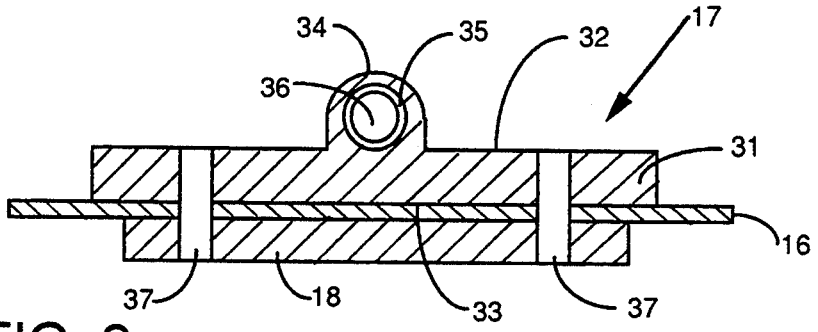
FIG. 2 is a cross sectional view of a bracket of the invention as attached to a spine of a suitcase.
Figure 3:
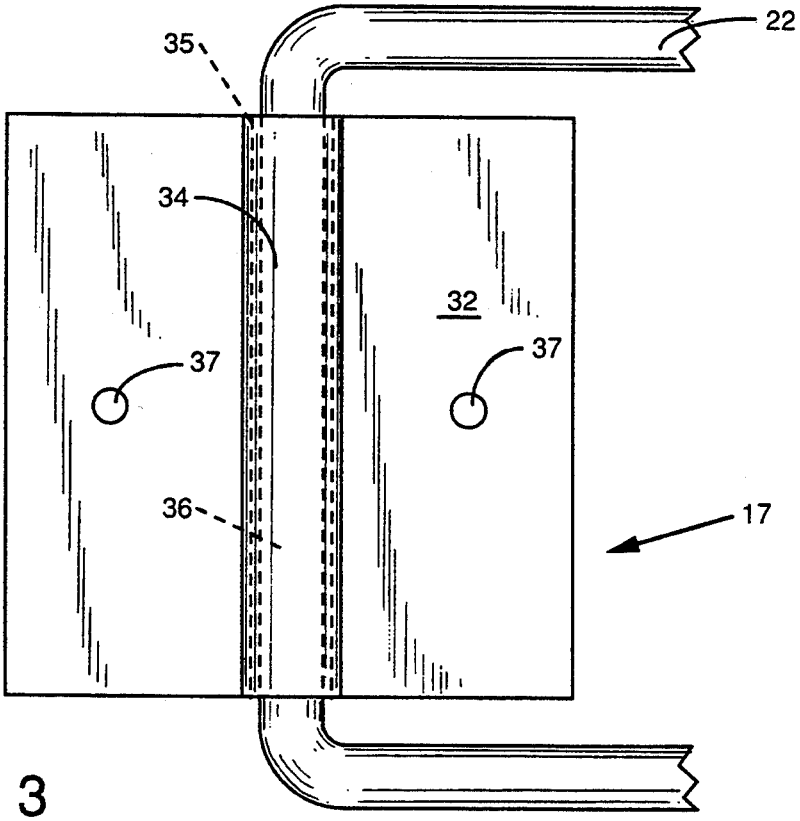
FIG. 3 is a plan view of the bracket of FIG. 2.

As further illustrated in FIGS. 1, 2, and 3, the pull handle 22 is pivotally connected to a bracket means 17 which is connected to the spine 18, for example with one or more fasteners 23. Because the bracket 17 extends in a transverse direction relative to the spine 18, and because the pull handle 22 is rotatably connected to the bracket 17, when the pull handle 22*a* is pulled, the load contained in the suitcase tends to be transferred evenly across the spine 18. Because the handle 22 is rigid, and separated by a distance represented by the separated points 24 and 25, the suitcase tends to follow a straight path when pulled, and avoids fishtailing. If a fishtailing tendency is sensed by the user of the pull handle, the rigidity of the handle and secured fastening of the handle 22 to the bracket 17 allow the user to quickly correct the situation.

The bracket 17 of FIGS. 2 and 3 includes a plate 31 having a top surface 32 and a bottom surface 33. In one embodiment of the invention, the top surface 33 has affixed thereto or integral therewith a flange 34 having a passage 35 therethrough for receiving a pivot rod 36 therethrough. The pivot rod 36 has two ends which extend out either side of the flange 34 and attached to the pull handle, thereby defining the two separated points 24 and 25 discussed previously. The bracket means 17 may further include one or more holes 37 therethrough for fastening the bracket 17 to the suitcase 10. Preferably, the bracket 17 is fastened to the spine 18 at least at two points 23 in order to more securely fasten the bracket 17 to the suitcase.

The suitcase 10 of FIG. 1 comprises a semi-rigid suitcase in which the front side 12 and back side 14 are of a relatively soft material, such as reinforced nylon. This embodiment further preferably includes a slide fastener 26 for securely closing the front side 12 about its periphery to the wall member 16. In this embodiment, the rigid spine 18 is secured to the wall member 16 between The front and back sides 12 and 14 and most preferably is substantially equally spaced between the front and back sides 12 and 14.

The suitcase 10 of FIG. 1 comprises a four-sided wall member 16 having a top side 40, a left side 41, a right side 42, and a bottom 43 connected at four corners. Most preferably, the bottom 43 is rigid across the entire area thereof, and fixed with a series of rolling means 44, such as casters, wheels, rollers, etc., known to those skilled in the art. The top side 40 may further include a carrying handle 28 fastened to the top side for carrying the suitcase, the pull handle being adapted to be secured out of the way to facilitate use of the carrying handle 28. In the embodiment of FIG. 1 the carrying handle 28 passes through the opening in the pull handle 22 when the pull handle is in the storage position and retained by the retaining means 30.

It will be readily appreciated by those skilled in the art that the bracket 17 should have an appreciable width to maximize the control over fishtailing when the suitcase 10 is pulled across a surface. In general, the narrower the bracket 17, the less the amount of control over a fishtailing suitcase.

Figure 4:
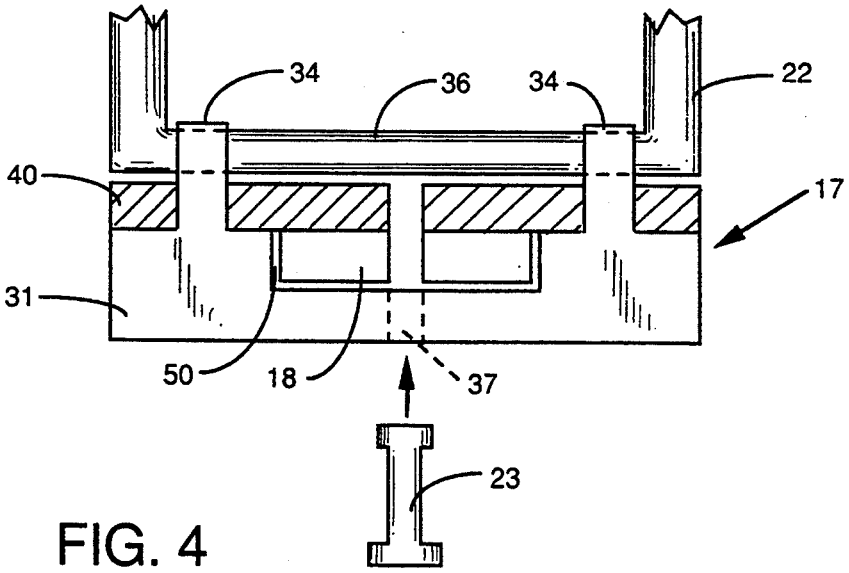
FIG. 4 is a cross sectional view of another bracket of the invention attached to a spine of a suitcase.

Another embodiment of the invention is illustrated in FIG. 4. In this embodiment, the bracket 17 is positioned below the suitcase top side 40, and has a pair of sockets 34 extending through the top side 40. These sockets receive the pivot rod 36 of the handle 22 therethrough as illustrated. The embodiment of FIG. 4 may be fastened to the spine 18 by a fastener 23 passing through a hole 37 communicating with the bracket 17, spine 18, and top side 40 as illustrated. In this embodiment, only one fastener 23 need be used because the bracket 17 derives lateral stability from the spine 18 itself, being positioned within a groove 50 in the bracket 17.

Alternatively, the bracket 17 may be recessed within the top side 40 so the bracket 17 does not protrude above the top side 40, including, for example, sockets built into the top side or the bracket for rotatably receiving the handle 22. Additionally, the bracket need not be affixed to the top side 40, but may be conveniently affixed to the spine 18 on the left side 41 or right side 42 of the peripheral wall member 16.

The retaining means 30 may comprise a strap having velcro, snaps, buckles, or any other suitable fastening means for maintaining the handle 22 in a storage position as illustrated. Optionally, The retaining means 30 may comprise a groove-and-snap configuration built into the wall member 16 to securely retain the handle 22 in the storage position.

Figure 5:
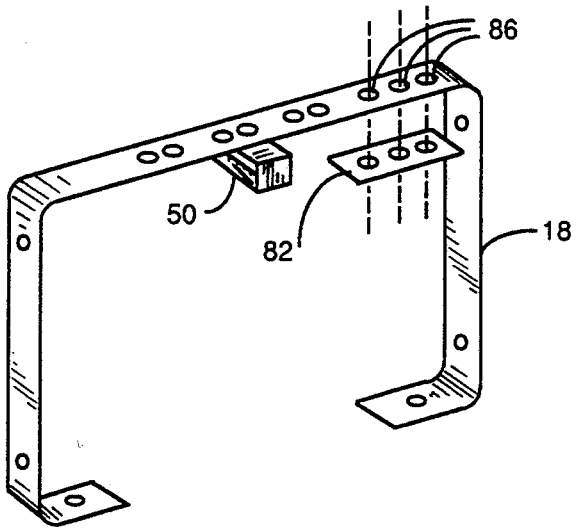
FIG. 5 illustrates a hanger bracket attached to the spine of a suitcase of the invention.
Figure 6:
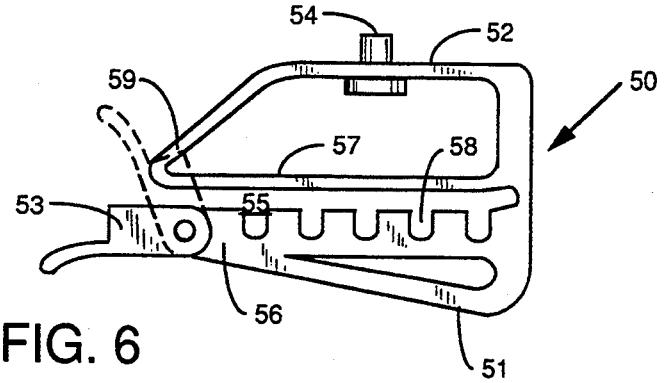
FIG. 6 illustrates in greater detail the hanger bracket of FIG. 5

Yet another embodiment of the invention is illustrated in FIG. 5. In this embodiment, a hanger bracket 50 is fastened to the spine 18 on the interior of the suitcase. The hanger bracket 50 may be of any suitable configuration, provided it securely holds a hanger hook. FIG. 6 illustrates in greater detail a preferred hanger bracket 50, having an upper attachment flange 52 through which passes a fastener 54, such as a rivet, bolt, or the like, for rigidly securing the hanger bracket 50 to the spine 18. The hanger bracket 50 further includes a hanger arm 56, on which hanger hooks may be hung. The hanger arm 56 may further include one or more notches 58 to prevent the hanger hooks from sliding and to maintain spacing between adjacent hangers. The hanger arm 56 is preferably provided with a support member 51 for imparting added support to the hanger arm 56 when it is under load. The hanger bracket also preferably includes a closure member 53 for closing the space 55 defined by the lower portion 57 of the upper attachment flange 52 and the hanger arm 56. The closure member 53 preferably snaps into place, in engagement with the frontal portion 59 of the upper attachment flange 52, as shown in phantom in FIG. 6, thereby retaining hangers on the hanger bracket.

Figure 7A:
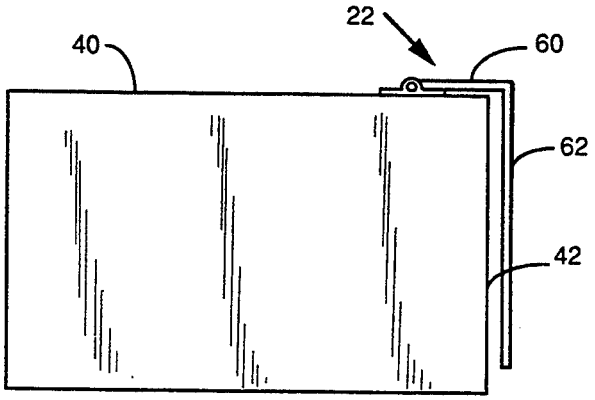
FIG. 7A is a front view of a preferred embodiment of a suitcase of the present invention.
Figure 7B:
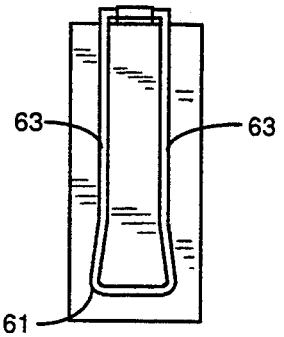
FIG. 7B is a side view of the suitcase of FIG. 7A.

Referring now to FIGS. 7A–B and 8A–B there are illustrated a number of alternative pull handle configurations of the invention. As illustrated in FIG. 7A and 7B, the pull handle 22 may be configured in an "L" shape, having a first leg 60 joined at a right angle to a second leg 62 such that the handle conforms to the top side 40 and right side 42 when in the storage position. First leg 60 is pivotally secured to the spine of the suitcase. As shown in FIG. 7B, the handle 22 may include an enlarged gripping member 61, providing a width greater than the spacing of the pull handle arms 63 joined by the gripping member 61. In another embodiment, the pull handle 22 may eliminate the first leg 60, and pivotally secure the second leg 62 to the right side 42 instead of to the top side 40 as shown in FIG. 1.

Figure 8A:
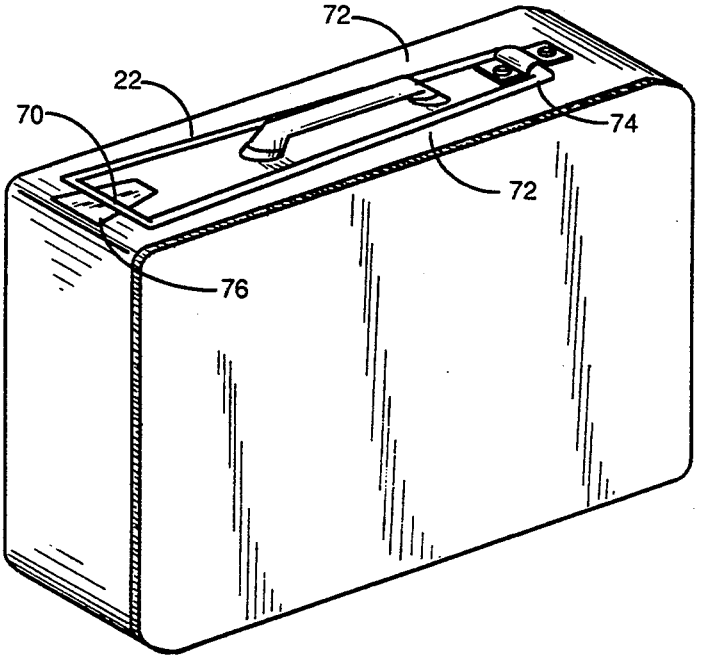
FIG. 8A is a perspective view of a preferred pull handle configuration of the invention.
Figure 8B:
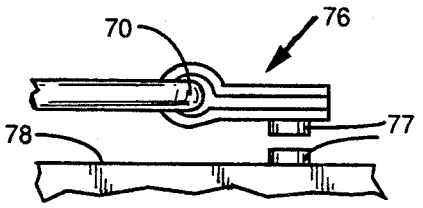
FIG. 8B is a detail of a portion of the pull handle of FIG. 8A.

FIG. 8A illustrates yet another preferred pull handle 22 having an enlarged gripping member 70 which is joined on either end by pull handle arms 72 that taper to a narrower end 74 which is pivotally connected to a bracket as previously described. The enlarged gripping handle may include a fastener 76 for securing the pull handle 22 in a stored portion as illustrated in FIG. 8A. The fastener 76 is shown in greater detail in FIG. 8B, which shows the fastener 76 wrapped around the enlarged gripping member 70, and having a fastening means, such as a snap 77, for securing the pull handle 22 to the top side 78 of the suitcase. The fastener 76! may be fabricated of any durable, flexible material, such as canvas, plastic, leather or the like. The fastener also serves to cushion the hand of the user when the pull handle is being used to pull the luggage case. Alternatively, one end of fastener 76 may be permanently attached to the luggage case and the other end may be selectively attached to the fastener using a well known type of fastener.

Figure 10:
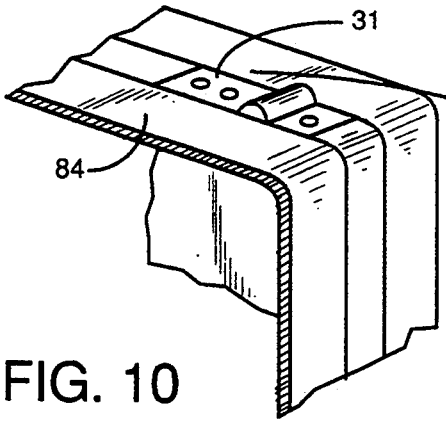
FIG. 10 is a perspective view of a suitcase having attached thereto the bracket of FIG. 9.
Figure 9:
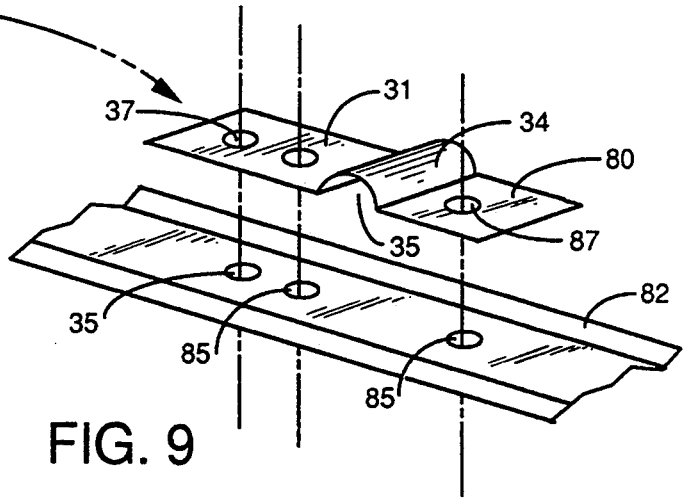
FIG. 9 in a perspective view of a bracket of the invention.

FIG. 9 illustrates an alternative bracket assembly of the invention, comprising an upper bracket portion 80 and a frame reinforcement member 82. The upper bracket portion 80 has a plate 31 and a flange 34 with a passage 35 therethrough for receiving a pivot rod therethrough as previously described. The reinforcement member 82 is placed on the internal side of the spine 18 as illustrated in FIG. 5. The plate 31 is placed on the top (or side) 34 of the suitcase (FIG. 10) and secured with suitable fasteners, such as rivets, passing through holes 85 in the reinforcement member 82, 86 in the suitcase, and 87 in the plate 31 . As illustrated, the holes 85, 86 and 87 are arranged to line up with one another. In the embodiment of FIGS. 9–11 three fasteners are used to secure the upper bracket portion 80 and the reinforcement member 82 to the spine 18.

Whereas particular embodiments of the invention have been described herein, for purposes of illustration, will be evident to those skilled in the art that numerous variations of the details may be made without departing from the invention as defined in the appended claims.

I claim:

1. A suitcase having spaced, generally parallel front and back sides connected about their periphery to a peripheral wall member extending between the front and back sides and thereby defining a volume, a spine affixed to the wall member around the periphery of the suitcase, the spine providing support to the wall member, roller means mounted on said wall member positioned to support said suitcase when in upright position and enabling rolling movement of said suitcase across a surface when the suitcase is entirely supported by said roller means, a rigid pull handle connected to the spine at separated points positioned transversely of the spine, the pull handle being pivotally mounted on an axis transverse to the spine and rotatable about that axis between a pulling position in which the handle extends outwardly from the suitcase and a storage position in which the handle is in juxtaposition to the peripheral wall member, said pull handle including a gripping member, and two extension arms, each said extension arm having two ends and said gripping member being connected to one end of each of said extension arms, the other end of each extension arm being pivotally connected to the spine at said separated points, the handle enabling the suitcase to be pulled across the surface in upright position with its weight being carried by said roller means when the handle is in the pulling position.

2. The suitcase of claim 1 wherein said extension arms taper respectively outwardly from a point of pivoted connection to said spine to a point of connection to said gripping member.

3. The suitcase of claim 1 wherein said pull handle is formed in an "L" shape such that said handle substantially conforms no two contiguous sides of said suitcase when said handle is in a storage position.

4. The suitcase of claim 1 wherein said two extension arms are parallel.

5. The suitcase of claim 4 wherein said gripping member has a width greater than the width separating said parallel extension arms.

6. A suitcase having spaced, generally parallel front and back sides connected about their periphery to a peripheral wall member extending between the front and back sides and thereby defining a volume, a spine affixed to the wall member around the periphery thereof, the spine providing support to the wall member, roller means mounted on said wall member positioned to support said suitcase when in upright position and enabling rolling movement of said suitcase across a surface when the suitcase is entirely supported by said roller means, a rigid pull handle connected to the spine at separate points positioned transversely of the spine, the pull handle being pivotally mounted on an axis transverse to the spine and rotatable about that axis between a pulling position in which the handle extends outwardly from the suitcase and a storage position in which the handle is in juxtaposition to the peripheral wall member, the handle enabling the suitcase to be pulled across the surface in upright position with its weight being carried by said rolling means when the handle is in the pulling position, and hanger bracket means fastened to said spine internal of said suitcase for holding clothes hangers.

7. The suitcase of claim 6 wherein said hanger bracket means include closure means for retaining hangers on said hanger bracket.

8. The suitcase of claim 6 wherein said hanger bracket means is mounted to the internal surface of the top wall of said suitcase.

9. A suitcase having spaced, generally parallel front and back sides connected about their periphery to a peripheral wall member extending between the front and back sides and thereby defining a volume, a spine affixed to the wall member around the periphery thereof, the spine providing support to the wall member, roller means mounted on said wall member positioned to support said suitcase when in upright position and enabling rolling movement of said suitcase across a surface when the suitcase is entirely supported by said roller means, a rigid pull handle connected to the sine at separated points positioned transversely of the spine, the pull handle being pivotally mounted on an axis transverse to the spine and rotatable about that axis between a pulling position in which the handle extends outwardly from the suitcase and a storage position in which the handle is in juxtaposition to the peripheral wall member, the handle enabling the suitcase to be pulled across the surface in upright position with its weight being carried by said rolling means, when the handle is in the pulling position, bracket means to pivotally mount said pull handle to said spine, the bracket means transferring a pulled load transversely of the spine, said bracket means includes an upper bracket member fastened to said spine on the extension of said suitcase, and said bracket means further comprises a reinforcement member fastened to said spine on the interior of said suitcase.

10. A suitcase having spaced, generally parallel front and back sides connected about their periphery to a peripheral wall member extending between the front and back sides and thereby defining a volume, a spine affixed to the wall member around the periphery of the suitcase, the spine providing support to the wall member, roller means mounted on said wall member positioned to support said suitcase when in upright position and enabling rolling movement of said suitcase across a surface when the suitcase is entirely supported by said roller means, a rigid pull handle connected to the spine at separated points positioned transversely of the spine, said pull handle being pivotally mounted on an axis transverse to the spine and rotatable about that axis between a pulling position in which the handle extends outwardly from the suitcase in a storage position and which the handle is in juxtaposition to the peripheral wall member, said pull handle including a first leg having two ends and a second leg having two ends, one end of said first leg being pivotally mounted on said axis transverse to said spine and another end of said first leg being joined to one end of said second leg to form an "L" shape such that said handle substantially conforms to two continuous sides of said suitcase when said handle is in a storage position, and a gripping member connected to another end of said second leg, the handle enabling the suitcase to be pulled across the surface in an upright position with its weight being carried by said roller means when the handle is in the pulling position.

11. The suitcase of claim 10, wherein said first leg comprising two generally parallel members and said second leg comprising two generally parallel members.

* * * * *

UNITED STATES PATENT AND TRADEMARK OFFICE

CERTIFICATE OF CORRECTION

PATENT NO. : 5,350,046

DATED : September 27, 1994

INVENTOR(S) : Thomas Falloon

It is certified that error appears in the above-indentified patent and that said Letters Patent is hereby corrected as shown below:

Column 5, line 16, "76!" should be -- 76 --.

Column 5, line 43, before "will", -- it -- should be inserted.

Claim 3, column 6, line 11, "no" should be -- to --.

Signed and Sealed this

Twenty-first Day of February, 1995

*Attest:*

Bruce Lehman

BRUCE LEHMAN

*Attesting Officer*

*Commissioner of Patents and Trademarks*